United States Patent [19]

Takahasi et al.

[11] 4,086,951

[45] May 2, 1978

[54] APPARATUS FOR CHANGING WIDTH OF A CAST PIECE IN A CONTINUOUS CASTING OPERATION

[75] Inventors: Riyota Takahasi; Takayosi Yamada; Makoto Kimura; Seiji Yosikawa, all of Tohkai, Japan

[73] Assignee: Nippon Steel Corporation, Tokyo, Japan

[21] Appl. No.: 758,780

[22] Filed: Jan. 12, 1977

Related U.S. Application Data

[62] Division of Ser. No. 585,505, Jun. 10, 1975, Pat. No. 4,022,265.

[30] Foreign Application Priority Data

Jun. 12, 1974 Japan ..... 49-67006

[51] Int. Cl.[2] ..... B22D 11/06

[52] U.S. Cl. ..... 164/73; 164/82; 164/436

[58] Field of Search ..... 164/73, 82, 273 R, 274, 164/280, 283 M

[56] References Cited

U.S. PATENT DOCUMENTS 3,451,465 6/1969 Moritz ..... 164/73 X 3,612,150 10/1971 Rossi ..... 164/82

3,794,105 2/1974 Voss ..... 164/73 X

FOREIGN PATENT DOCUMENTS 2,018,962 11/1971 Germany ..... 164/82

*Primary Examiner*—Robert L. Spicer, Jr.

*Attorney, Agent, or Firm*—Watson, Leavenworth, Kelton & Taggart

[57] ABSTRACT

A method of enlarging width of a cast piece during continuous casting. It comprises stopping pouring a molten steel into a mold during continuous casting, positioning a supporting plate at the bottom of the mold without lowering the surface of the bath, moving a short wall of the mold, placing a cooling agent on the supporting plate inside the mold, pouring the molten steel into the mold to obtain a cast piece, and thereafter removing the supportng plate to withdraw the cast piece. An apparatus for placing the supporting plate such that it can move back and fore freely on the bottom of the moving short wall of the mold is provided. In order to smooth the movement of the short wall of the mold, a lubricating agent may be placed at a portion where the long walls contact the short wall of the mold, or holes or grooves for supplying lubricating agent may be provided on both ends of the short wall of the mold.

2 Claims, 13 Drawing Figures

APPARATUS FOR CHANGING WIDTH OF A CAST PIECE IN A CONTINUOUS CASTING OPERATION

RELATED U.S. APPLICATION

This is a division, of application Ser. No. 585,505, filed June 10, 1975 now U.S. Pat. No. 4,022,265.

DETAILED DESCRIPTION OF THE INVENTION

This invention relates to a method and apparatus for changing width of a cast piece or strand in a continuous casting operation.

In the continuous casting process, a mold 3 is constructed by long copper plates or walls 1, 1' and short copper plates or walls 2, 2', as shown in FIG. 1, in which a molten steel is poured and solidified partly, and thereafter a cast piece or strand is continuously pulled down from the bottom of the mold 3.

When it is desired to change the size or width of a cast piece, the pouring of the molten steel into the mold 3 is stopped; the molten steel as poured into the mold 3 is pulled down as a cast piece; thereafter one or both of the short walls 2, 2' of the mold 3 are moved; a dummy bar corresponding to a changed width is positioned at the bottom of the mold 3; the molten steel is again poured into the mold 3; and a cast piece with a new or changed width is recovered.

Accordingly, it has disadvantages that a casting operation must be stopped completely each time the width of a casting is changed; that it takes a considerable time before the casting operation is resumed; and that the productivity of the continuous casting operation is thus largely lowered.

It is therefore an object of the invention to provide a method and apparatus for effectively overcoming the above-mentioned disadvantages which have been encountered in the prior art.

According to this invention, there is provided a method (1) for enlarging a width of a cast piece in a continuous casting operation which comprises stopping pouring a molten steel into a mold, said mold consisting essentially of long walls and short walls, positioning a base or supporting plate at the bottom of the mold without lowering the surface of the bath, moving the short wall, placing a cooling agent on the supporting plate inside the mold, pouring the molten steel into the mold to obtain a cast piece, and thereafter removing the base plate to recover the cast piece.

According to this invention, there is also provided a method according to the above method (1) in which a lubricating agent is applied at a portion where the long walls contact the short wall of the mold, and the short wall is moved to change the width of a cast piece.

According to this invention, there is further provided a mold for continuous casting operation adapted for use in the above method (1) in which holes or grooves for supplying a lubricating agent are provided on both ends of a short wall of the mold.

According to this invention, there is still further provided an apparatus for enlarging the width of a cast piece adapted for use in the above method (1) in which a supporting plate is positioned such that it can move back and fore freely on the bottom of the moving short wall of the mold.

According to this invention, there is additionally provided a cooling agent covered with a consumable material adapted for use in the above method (1).

This invention is further described with respect to the drawings.

FIG. 1 is a schematic plan view of a mold used for continuous casting operation.

FIG. 2 (*a*) to (*d*) is a schematic sectional elevational view explaining a way of changing width of a cast piece according to this invention.

Figure 1:
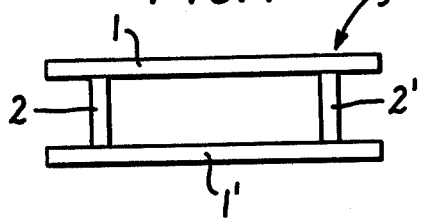
Figure 2A:
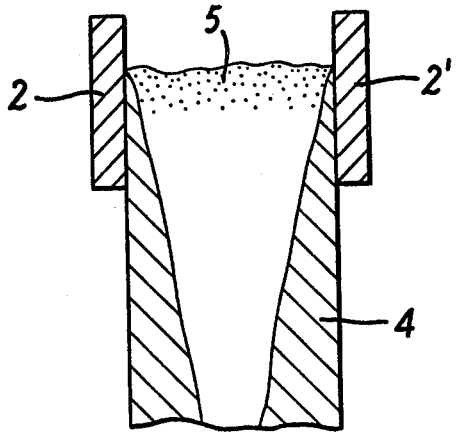
Figure 2B:
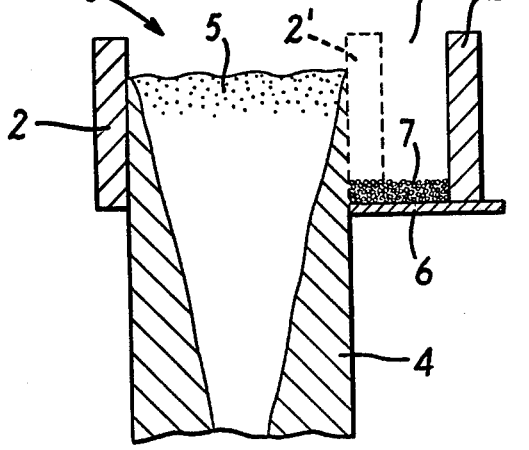
Figure 2C:
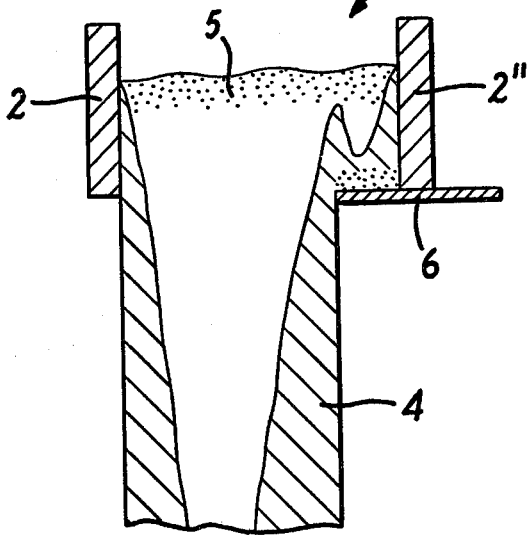
Figure 2D:
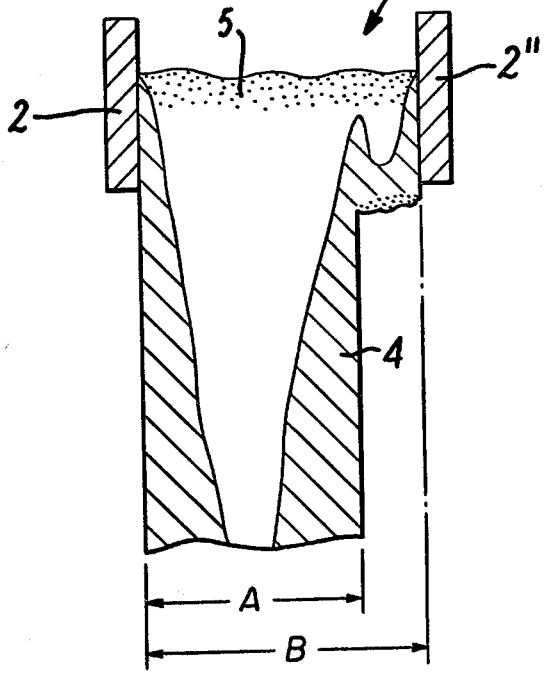

In the practice of this invention, a cast piece 4 of a predetermined width is obtained by pouring a molten steel 5 into a mold 3 as shown, in FIG. 2(*a*). When it is desired to enlarge the width of said cast piece 4 during this casting operation, the pouring of the molten steel into the mold 3 is stopped; a base or supporting plate 6 made of iron, etc. is positioned at the bottom portion of the mold 3 where the short plate 2' is going to move, without lowering the surface of the bath; the short plate 2' is then moved to a position 2''; and a cooling agent 7 such as steel chips, scales, etc. is placed on the supporting plate 6, as shown in FIG. 2(*b*).

The provision of the cooling agent 7 is intended not only to protect the supporting plate 6 but also to solidify earlier the molten steel which is subsequently poured at a position where it contacts the supporting plate 6, so the recovery or withdrawal of the cast piece can be done rapidly.

Then, the molten steel is poured into the mold 3. The molten steel thus poured overflows a solidification layer or outer shell made at the position where it contacted the short wall 2' and is poured into a space or enlarged portion 8 (FIG. 2(*b*)) formed by movement of the short wall from 2' to 2'', which results in a condition shown in FIG. 2(*c*).

Thereafter, when the molten steel which has been poured on the supporting plate 6 comes into a solidification condition suitable for withdrawal, the cast piece 4 is withdrawn. As a result, the width A of the cast piece 4 can be enlarged to the width B as shown in FIG. 2(*d*).

According to this invention, the width of a cast piece can be enlarged without complete stop of the casting operation as stated above. Consequently, the time for stopping the casting operation due to change of the width of a cast piece can remarkably be shortened, and therefore, the productivity can largely be enhanced. Furthermore, there is an additional advantage that the casting operation can be resumed earlier and in more simplified way because the casting operation is not stopped completely in the practice of this invention.

In case that the short wall 2′ is moved as above, it is inevitable to first loosen the long walls 1 and 1′ before the short wall 2′ is moved and to fasten the same again after the short wall 2′ is moved to 2″, since the short wall 2′ is usually pinched tightly between the long walls 1 and 1′. It often gives rise to complication in changing operation of the width of a cast piece 4, which may retard said operation.

This defect can be improved in this invention by placing a lubricating agent in portions where the long walls contact the short wall, and moving the short wall as it is pinched between the long walls. For example, in setting a mold, a lubricating agent is preliminarily coated upon portions where the long walls and the short wall are contacted each other, and when it is desired to change the width of the cast piece, the short wall is caused to move as stated above.

The lubricating agent used is a commercially available one of resin system, MO system, C system, etc., which may have a sufficient lubricative function. In other words, as the portions where the long and short walls contact each other do not directly contact the molten steel and the long and short walls themselves are cooled by circulation of a water or other cooling medium inside the mold to protect the mold from the heat of molten steel, the lubricating agent applied is not burnt out whereby the short wall can be moved easily and smoothly.

Figure 4:
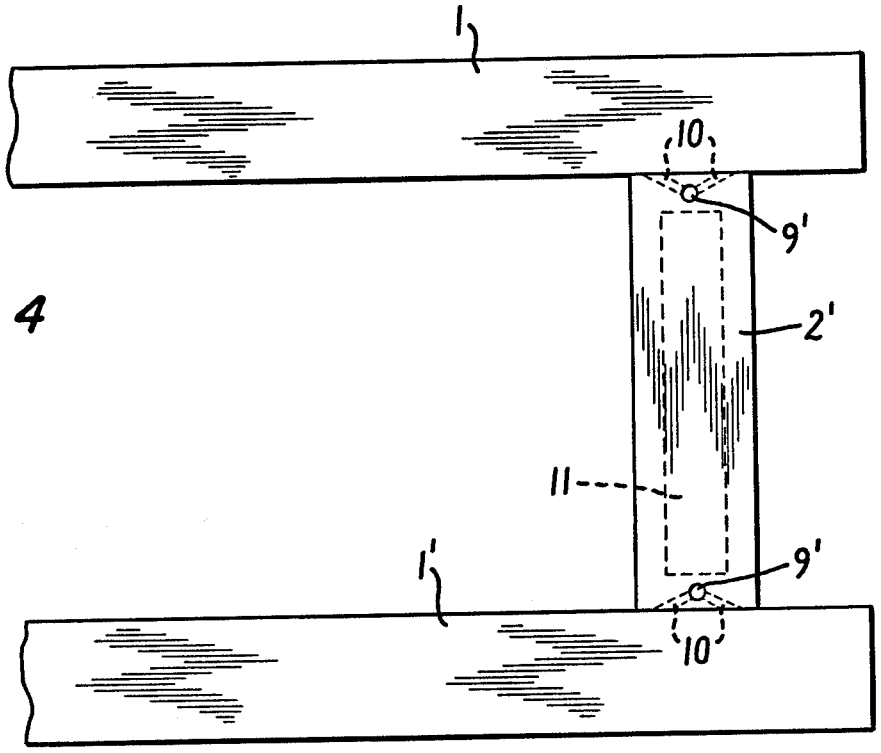
FIG. 4 is a plan view illustrating one example of apparatus for supplying a lubricating agent according to this invention.
Figure 5:
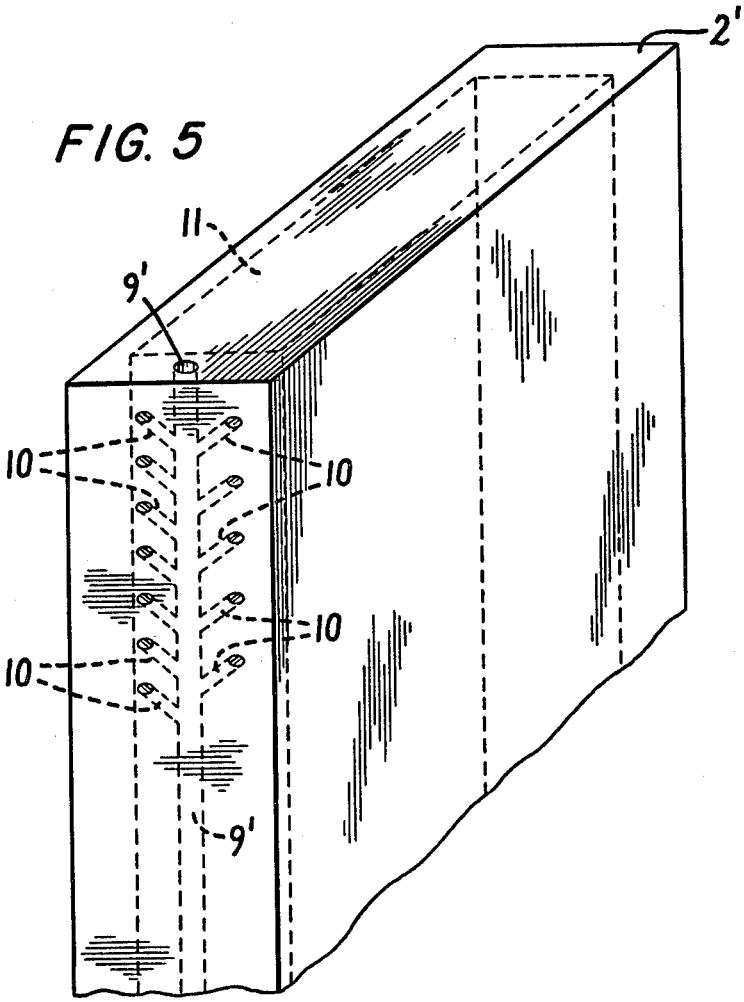
FIG. 5 is a perspective view of the apparatus shown in FIG. 4.

Alternatively, holes 10 are provided on both ends of the short wall, to which pipes 9′ for supplying a lubricating agent is connected from inside the mold, so that the short wall can be moved smoothly while the lubricating agent is being fed into the portion where the short wall contacts the long walls, as shown in FIGS. 4 and 5.

Figure 6:
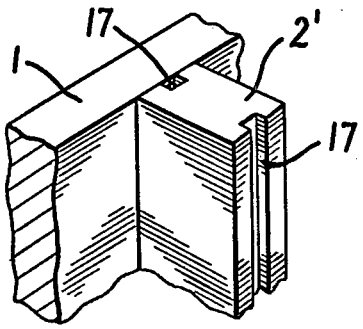
FIG. 6 is a perspective view of another apparatus for supplying a lubricating agent according to this invention.

Still alternatively, grooves 17 as shown in FIG. 6 are provided, on both ends of the short wall where it contacts the long walls, so that the short wall can be moved smoothly while the cooling agent is being supplied to said grooves.

Under such operation. the short wall can be moved without loosening the long walls from the short wall, which results in such excellent effect as rapidly changing the width of a cast piece.

Moreover, in the practice of this invention, an apparatus for moving the supporting plate back and fore is provided to effect the change of the width of a cast piece so rapidly and accurately.

Furthermore, it is noted that, when a cooling agent is placed on the supporting plate for changing the width of a cast piece, the "break-out" may occur in a thin layer of the cooling agent if it is not distributed uniformly on said plate, and that a cooling agent thus placed may drop from said plate if the enlargement of the width of a cast piece is so small as 10 mm to 50 mm. The amount of the cooling agent which has dropped outside the mold is usually difficult to determine and thus it is impossible to grasp the exact amount to be supplemented therefor. In this case, this invention may provide an effective countermeasure. That is, such cooling agent as steel chips, nail scraps, etc. is covered or packed by a consumable material. Such consumable material may be other material than metal which can be burnt out at a temperature more than about 1300° C, but it may preferably be paper or a resin such as polyethylene and the like. If an ignitable or inflammable material such as celluloid, etc. having a low melting point is applied to the internal surface thereof, it can be burnt out or consumed more rapidly.

When the cooling agent packed with the consumable material is placed in a space resulting from movement of the short wall, the inflammable material can easily be burnt out due to the heat of a cast piece, which results in that the cooling agent is uniformly scattered or distributed over the surface of the supporting plate.

Preferable examples of this invention are shown below.

EXAMPLE 1

In the practice of a bending type continuous casting, a molten steel having the composition by weight of 0.05% C, 0.28 % Mn, 0.013% S, 0.01% P, 0.060% sol. Al, the rest Fe; the temperature 1580° C was poured into a mold at a rate of 4.6 t/min., and thereby a cast piece having the width of 1400 mm and the thickness of 245 mm was produced at a withdrawl speed of 0.8 m/min. When it was desired to change the width of the cast piece to 2000 mm, the pouring of the molten steel into the mold was stopped, and a supporting plate made of iron having the thickness of 5 mm was positioned at the bottom of the mold where the short wall was to be moved. Then the short wall was moved for 600 mm to enlarge the width of the mold to 2000 mm, and steel chips were placed on the vacant surface of the supporting plate as the cooling agent with the thickness of 300 mm. The molten steel was again poured into the mold to fill the space formed by movement of the short wall. After three minutes, the change of the width of the cast piece to be withdrawn was thus finished.

As described above, it took only 2.0 minutes to change the width of a cast piece in this invention, as distinguished from the conventional case where it took as long as 50 minutes to do so.

EXAMPLE 2

Figure 3:
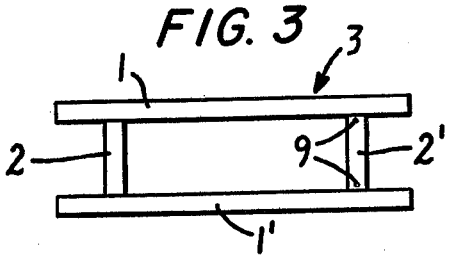
FIG. 3 is a schematic plan view of a mold for continuous casting operation illustrating an example of applying a lubricating agent according to this invention.

In the practice of a bending type continuous casting similar to that of Example 1, the molten steel was poured into the mold having the width of 1400 mm and the thickness of 245 mm to carry out a continuous casting at a withdrawl speed of 0.8 m/min. At the time when the above mold was set before casting, the Molicoat (MO system) was applied as a lubricating agent to the portions 9 as shown in FIG. 3 where the long walls 1 and 1′ contact the short wall 2′. In one hour after the casting began, the short wall 2′ was moved as shown in FIG. 2, without loosening the long walls, to the final width of 2000 mm. At this time it was quite easily and very rapidly moved. As a result, the operation for changing the width of the cast piece could be made very simple and smooth.

EXAMPLE 3

In the practice of a bending type continuous casting similar to that of Example 1, pipes 9′ for introducing a lubricating oil were provided inside the mold which were connected to holes 10 as shown in FIGS. 4 and 5. The holes 10 were provided on both ends of the short wall 2′.

When the short wall 2′ was moved, a lubricating oil was introduced into the pipes 9′ and then supplied via the holes 10 to the portions where the long walls 1 and 1′ contact the short wall 2′. Under this condition, the short wall 2′ was moved as it was pinched between the long walls 1 and 1′. The reference numeral 11 in FIGS.

4 and 5 is a region to which the primary cooling water was supplied.

An excellent result similar to that of Example 2 was thus obtained.

EXAMPLE 4

Figure 7:
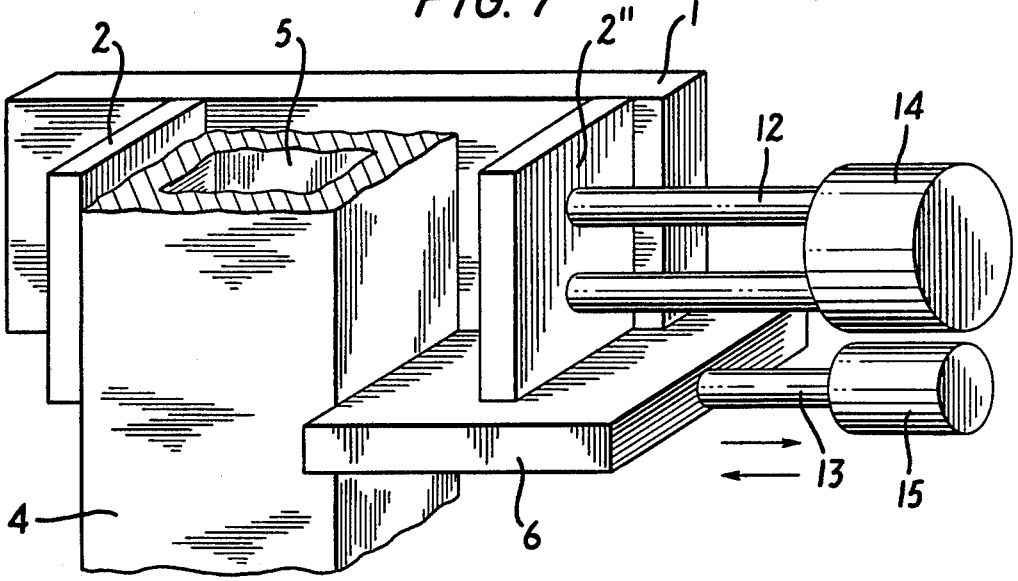
FIG. 7 is a perspective view illustrating one example of the apparatus for changing the width of a cast piece according to this invention.

In the practice of a bending type continuous casting similar to that of Example 1, pistons or shafts 12 were fixed with or without connecting means to the short wall 2''. Similarly, a piston or shaft 13 was fixed to the supporting plate 6, as shown in FIG. 7. These pistons or shafts were arranged such that they could be moved back and fore by any suitable driving means 14, 15 such as air or oil cylinder or electric motor and the like.

In this way, the enlargement of the width of the cast piece could be carried out rapidly and accurately. Moreover, it could save a lot of labors which would have otherwise been necessary to accomplish this operation.

EXAMPLE 5

Figure 8:
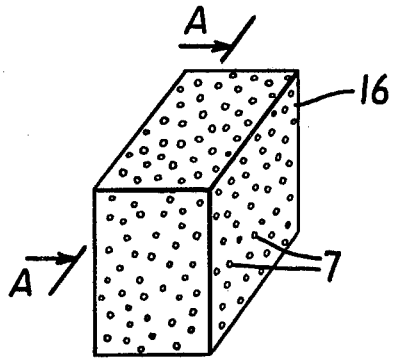
FIG. 8 is a perspective view illustrating one example of a cooling agent covered with a consumable material according to this invention.
Figure 9:
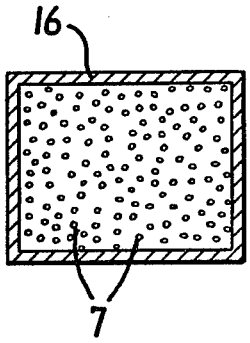
FIG. 9 is a sectional elevational view taken along line A—A of FIG. 8.
Figure 10:
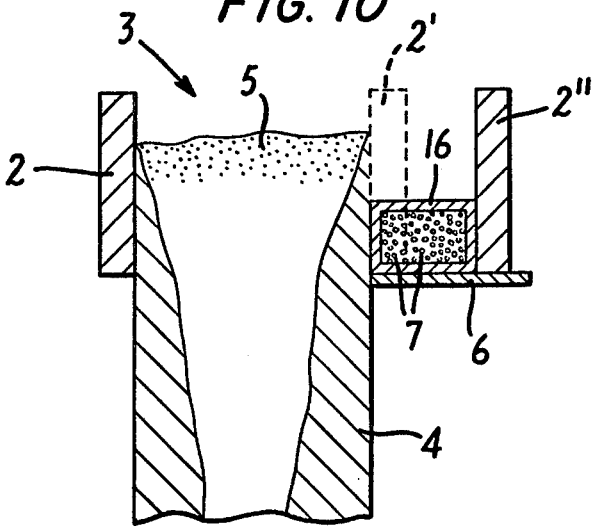
FIG. 10 is a sectional elevational view showing a use of the covered cooling agent shown in FIGS. 8 and 9.

In the practice of a bending type continuous casting similar to that of Example 1, a cooling agent 7 was wrapped by a consumable material 16 as shown in FIGS. 8 and 9, which was then placed in a space 8 on the supporting plate 6 between the molten steel 5 and the moved short wall 2'' as shown in FIG. 10. The consumable material 16 covering the cooling agent 7 was soon burnt out by the heat of the molten steel 5, which distributed the cooling agent 7 uniformly over the supporting plate 6. As a result, there were many advantages that such trouble as the "break out", etc. could be obviated in the operation, that the cooling agent could be simply and easily placed on the supporting plate, and that waste of the cooling agent could be avoided effectively.

The above examples are given merely as illustrative of this invention and are not to be considered as limiting. Any change or modification can be made thereto without departing from the spirit of this invention.

We claim:

1. An apparatus for enlarging the width of a cast piece which comprises a single mold consisting of a pair of opposed longitudinal walls and a pair of transverse walls extending between said longitudinal walls in contact therewith, at least one of said transverse walls being movable relative to said longitudinal walls for enlarging the width of the mold; a supporting plate disposed under said movable transverse wall; means for moving said movable transverse wall and connected to an outside wall surface of the movable transverse wall; and means for movably positioning said supporting plate back and fore freely under the movable transverse, said wall means being connected to an edge of the supporting plate.

2. The apparatus according to claim 1 in which said movable transverse wall has passages means at the edges thereof for supplying a lubricating agent outflow at both ends thereof when said transverse wall is moving in contact with said longitudinal walls.

* * * * *